US008403189B2

(12) United States Patent
Nyberg et al.

(10) Patent No.: US 8,403,189 B2
(45) Date of Patent: Mar. 26, 2013

(54) BABY CARRIER

(75) Inventors: Anders Nyberg, Lund (SE); Lisen Elmberg, Stockholm (SE)

(73) Assignee: BabyBjörn AB, Solna (SE)

( * ) Notice: Subject to any disclaimer, the term of this patent is extended or adjusted under 35 U.S.C. 154(b) by 1443 days.

(21) Appl. No.: 11/587,752

(22) PCT Filed: Jan. 30, 2006

(86) PCT No.: PCT/SE2006/000129

§ 371 (c)(1),
(2), (4) Date: Oct. 26, 2006

(87) PCT Pub. No.: WO2006/104437

PCT Pub. Date: Oct. 5, 2006

(65) Prior Publication Data

US 2007/0241146 A1 Oct. 18, 2007

(30) Foreign Application Priority Data

Mar. 31, 2005 (SE) ..... 0500700

(51) Int. Cl.
*A47D 13/02* (2006.01)

(52) U.S. Cl. ..... 224/160; 224/159

(58) Field of Classification Search ..... 224/158–161, 224/645; 119/770; 280/47.38; 297/284.4, 297/284.8, 301.5, 452.56, 452.11, 452.13, 297/452.16, 452.4, 452.63

See application file for complete search history.

(56) References Cited

U.S. PATENT DOCUMENTS

| | | | | |
|---|---|---|---|---|
| 2,477,164 | A * | 7/1949 | Bergman | 224/159 |
| 7,070,076 | B2 | 7/2006 | Bergkvist | |
| 2005/0173479 | A1 | 8/2005 | Gentil | |
| 2006/0011678 | A1 * | 1/2006 | Kassai et al. | 224/160 |
| 2006/0048722 | A1 * | 3/2006 | Elmberg | 119/770 |

FOREIGN PATENT DOCUMENTS

| | | | |
|---|---|---|---|
| WO | WO 03/000095 | A1 | 1/2003 |
| WO | WO 03/003880 | A1 | 1/2003 |
| WO | WO 03/082058 | A2 * | 10/2003 |

OTHER PUBLICATIONS

Translation of WO/03082058.*

* cited by examiner

*Primary Examiner* — Nathan J Newhouse
*Assistant Examiner* — Corey Skurdal
(74) *Attorney, Agent, or Firm* — Jacobson Holman PLLC

(57) ABSTRACT

A baby carrier has a harness and a harness-carried front piece which forms a baby-carrying pouch. The front piece includes two laterally separated parts at a variable spacing relative to one another. The laterally separated parts of the front piece are mutually connected to a strip-like piece of material whose lateral stretchability is much greater than the lateral stretchability of the separated parts of the front piece.

19 Claims, 3 Drawing Sheets

BABY CARRIER

CROSS-REFERENCE TO RELATED APPLICATION

This is a nationalization of PCT/SE06/000129 filed Jan. 30, 2006 and published in English.

BACKGROUND OF THE INVENTION

1. Field of Invention

The present invention relates to a baby carrier of the kind defined in the preamble of the accompanying claim 1.

2. Description of the Prior Art

A certain type of known baby carrier comprises a harness and a front piece which is carried by the harness and which forms a baby carrying pouch. The upper lateral corner portions of the front piece and its lower part are preferably detachably connected to corresponding nearby connecting points on the harness. The front peace is flexible and therefore shapes itself to some extent by lifting and folding under the influence of the weight of the baby carried in the pouch. The front piece is essentially comprised of a non-stretchable material, so as to provide comfortable support for the baby.

There is known in practice, however, a front piece which consists generally of a flexible essentially non-stretchable material, although this front piece is divided along a central vertical symmetry line. The adjacent edges of the front piece portions are therewith disposed at a horizontal distance from one another and are held together by lacing that extends along the nearby edges of said front piece parts. The lacing is formed by a series of through-penetrating openings or eyelets that are disposed along nearby edges of said front piece parts and a bight in a lace or cord whose both end parts extend alternately through vertically spaced holes in both of said rows, wherewith the ends of the laces cross one another repeatedly along the adjacent edges of the front piece. Lacing of the front piece can be adjusted to obtain different distances between said parts of the front piece, by tying together the laces at varying distances from their respective ends. Because the laces slide through their respective holes, the local width of the front piece can be varied as a result of the load exerted locally by the baby.

Although the greatest local load exerted by the baby promotes an increase in the corresponding local distance between said parts of the front piece, there occurs a decrease in the distance between said parts at other positions along the lacing due, to the distribution of load along nearby edges of these parts. This results in shaping of the front piece under the influence of the load exerted by the baby that can not be fully predicted, meaning, in turn, that although the front piece parts, which are mutually held together by the lacing, allow the front piece to shape itself so as to conform to the shape of the baby such shaping will not afford any additional comfort for the baby.

SUMMARY OF THE INVENTION

Accordingly, an aim of the present invention is to provide a baby carrier whose front piece is adapted to provide a local change in distance resulting from the local horizontal load between said parts of the front piece without said change in distance resulting in unfavorable distance changes in the opposite direction at other positions along the boundary region between said front piece parts.

This aim is achieved either completely or partially by means of the present invention.

The invention is described in the following written description.

Other embodiments of the invention will also be apparent from the following written description.

The front piece includes two laterally separated and generally mirror-image symmetrical parts which although being flexible are essentially non-stretchable. An important feature of the present invention is that these parts of the front piece are disposed laterally at a chosen relative distance apart and are joined together along essentially the whole of their vertical separation region by means of elastic material that has chosen elastic characteristics. The varying load generated by the baby along the height of the front piece will result in a corresponding horizontal change in the distance between said parts of the front piece. The shape of the front piece will thereby conform to the shape of the baby while, at the same time, making the front piece/carrying pouch more comfortable for the baby. This adaptation to the shape of the front piece is achieved with minimized folding or gathering of the front piece due to the elastic stretchability of the material that connects said parts of the front piece. In practice, the elastic material may comprise a strip-like element that extends vertically along the front piece generally along its entire height and centrally of the width region of the front piece. The elastic material may have a net-like character. The generally non-stretchable part of the front piece may also have a net-like character. In the case of one embodiment of the invention at present preferred, the elastic strip-like element disposed centrally in the front piece may have a width of about 7 cm, wherein the material of said element is chosen so that a horizontally directed load of 50 N which is uniformly distributed vertically along a length of 10 cm will cause the width of said element to increase by about 1.5 cm, i.e. corresponding to a horizontal stretch of the strip-like element by about 20%.

BRIEF DESCRIPTION OF THE DRAWINGS

The invention will now be described by way of example with reference to the accompanying drawing.

DETAILED DESCRIPTION OF THE PREFERRED EMBODIMENTS

Figure 1:
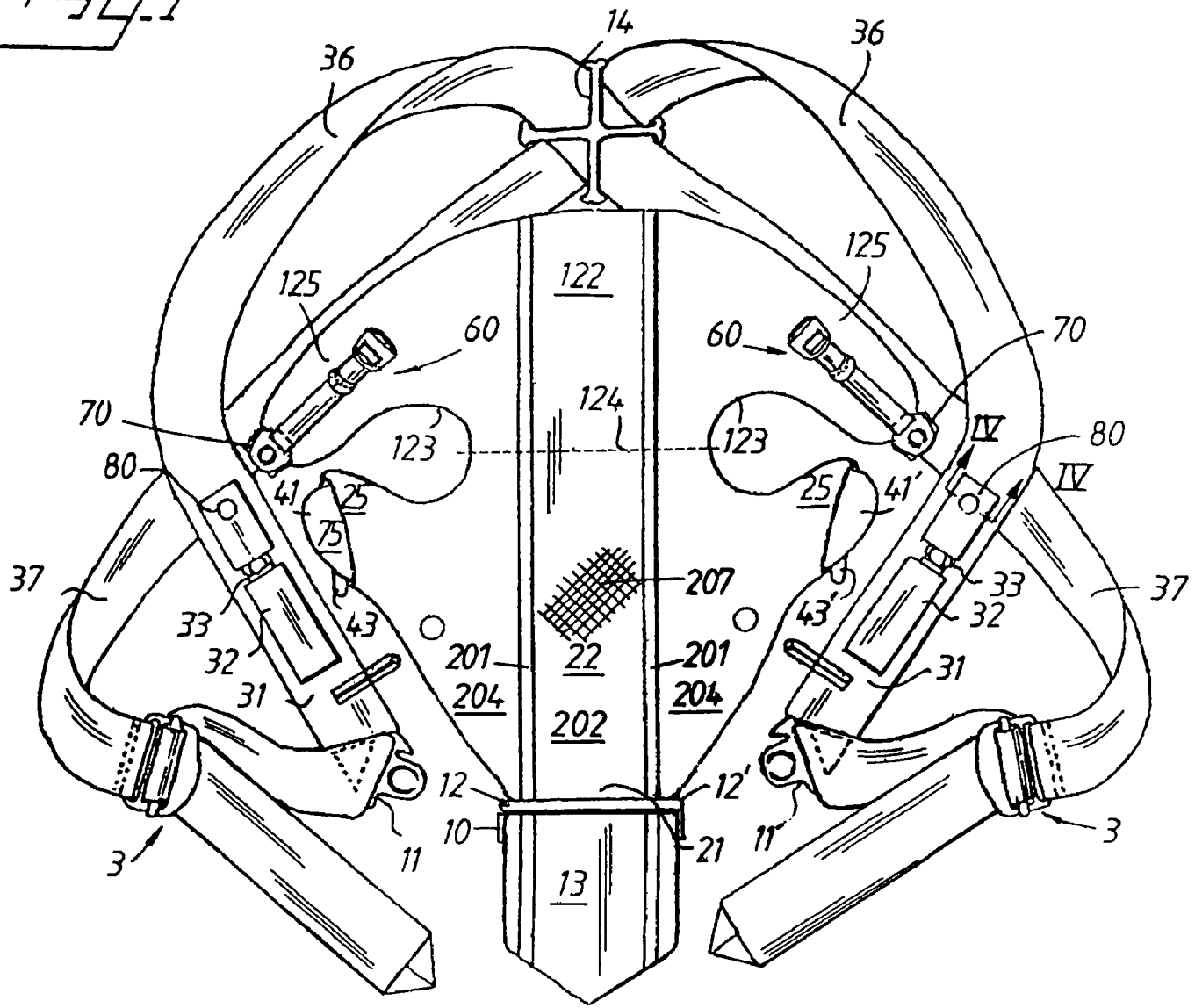
FIG. 1 is a diagrammatic illustration of an inventive baby carrier.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIGS. 1-4 illustrate a baby carrier whose structural components are known mainly from, for instance WO03/003880A1, and which comprises two chest straps 31 that are intended to extend generally vertically on each side of the wearers chest. Each chest strap 31 extends over a respective shoulder of the wearer and cross one another on the wearer's back. The strap portions 36 that cross one another on the wearer's back are held together by a fitting 14, wherewith a further strap portion 37 extends around the wearers hips, below said intersection point 14, and terminate in a coupling fitting 11, 11', to which the lower portion of the chest strap 31 also connects.

The strap portion 37 will also conveniently include an adjustment fitting 3 which enables the length of said strap portion to be readily adjusted.

The coupling fitting 11, 11' may be releasably connected to a corresponding coupling fitting 12, 12 in a holder 10 which receives a central strip-like lower part 21 of a front piece 22 in a length-adjustable fashion through the medium of an adjustment fitting 13. The front piece 22 may comprise a piece of flexible cloth or fabric, or corresponding material whose lower portion has a generally triangular shape, wherein the upper corners 25 of the triangle are provided with connectors 41, 41 which comprise a long downwardly directed finger 43 that can be received in a pocket 32 of corresponding depth on the front strap 31, via the upwardly located pocket inlet opening 33, so that the front piece will form a safe baby carrying pouch.

The front piece 22 also includes an upper edge part 122 that can be folded down onto and folded up from the lower part of the front piece 22 via a fold line 124. The front piece 22 has side recesses 123 at the level of the fold line 124. An opening for the legs of the baby is provided between the chest straps 31 on the one hand and the front piece 22 on the other hand in the region between the fittings 12, 75; 12', 75'. The upper edge part 122 can be folded down when the baby is awake. When the baby wishes to rest or to go to sleep, the upper edge part 122 can be folded up and its lateral ends 125 connected to nearby parts of the chest straps 31 with the aid of a releasable coupling that includes a first part 70 connected to the top of the part 125 and the second part 80 which is connected to the strap 31.

The edge part 122 is flexible, at least in the lateral end portions 125 and also with respect to folding of the edge part about the fold line 124. The coupling parts 70, 80 co-act with the edge part 122 so that the edge part will form a support for the head of a small and/or sleeping baby.

Figure 2:
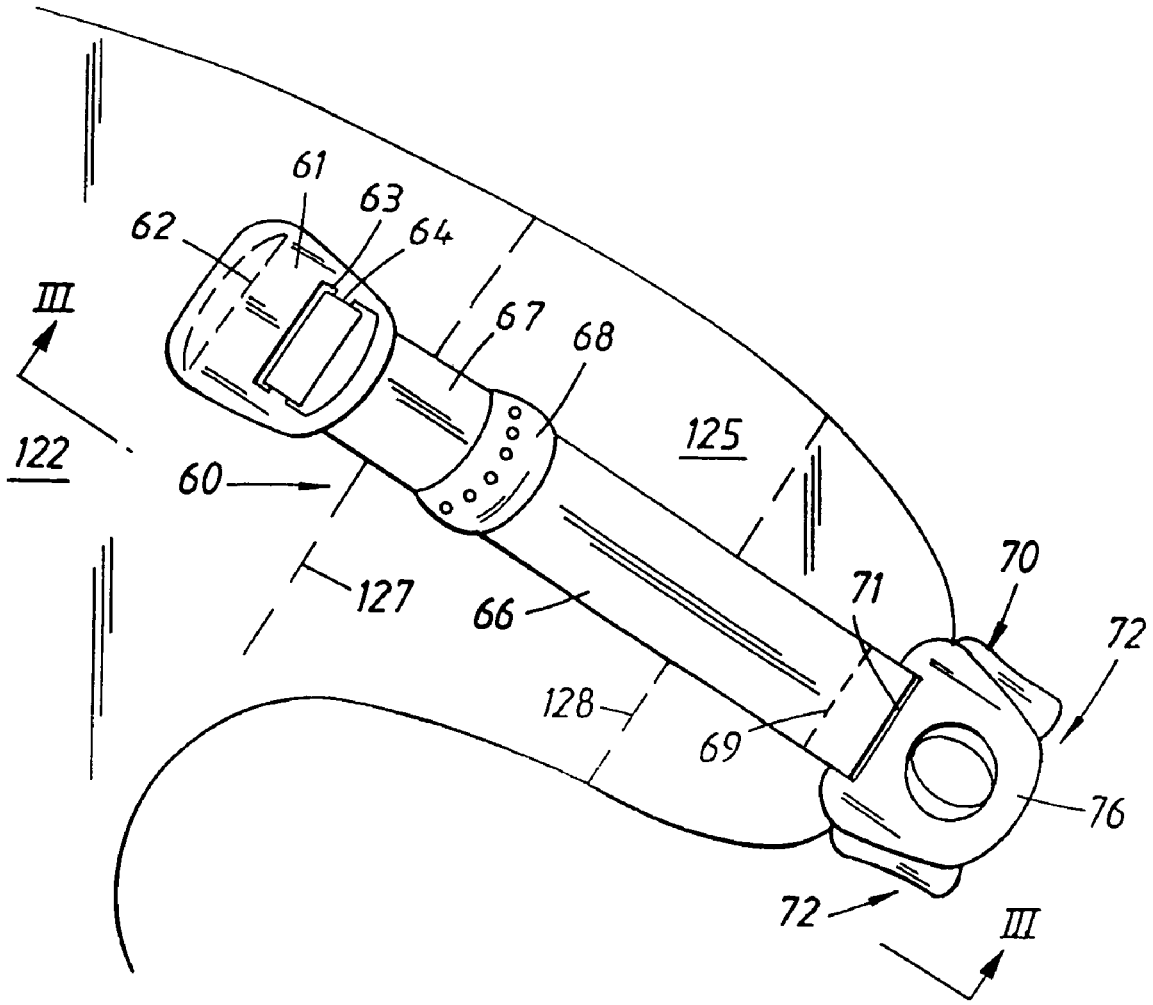
FIG. 2 is a broken view of a connecting means in the harness according to FIG. 1, together with a coupling element forming part of a coupling for connection the upper edge of the front piece to a harness chest strap.

As will be seen from FIG. 2, the first coupling part 70 is non-rotatably connected to the lateral end portion 125 of the part 122 with the aid of a seam 69, wherewith an end portion of a strap 66 extends through a slot 71 in the coupling part 70 and wherewith the seam 69 extends through both parts of the end portion of the strap 66 and the front piece.

An anchorage fitting 61 is sewn at 62 to the part 122 approximately midway of the symmetry line of the front piece 22. The fitting 61 includes two through-penetrating openings which are delimited one from the other by a post 64. The free end portion of the strap 66 extends through the opening 63 around the post. As will be seen, the free end 67 of said strap includes a finger grip 68 which functions to prevent the strap being drawn through the openings of the fitting 62. The fitting 62 co-acts with the strap 66 in a manner well known per se, therewith enabling the effective length of the strap 66 between the post 64 and the seam 65 to be adjusted, by pulling in the end 67 of the strap or by drawing the fitting 61 up around the seam 62 so as to allow the strap 66 to slide out of the fitting 61.

The strap 66 is orientated generally horizontally.

Figure 3:
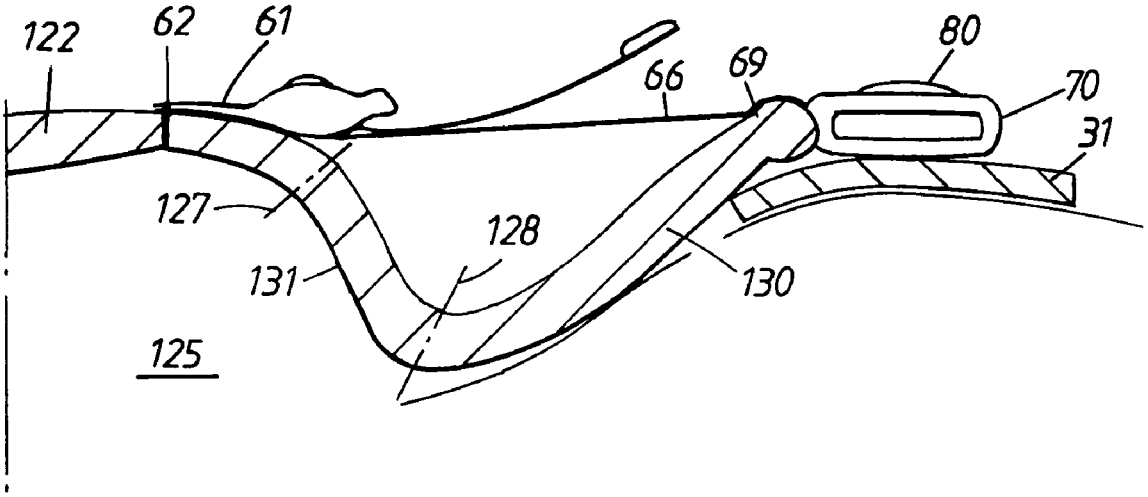
FIG. 3 is a schematic view on the line III-III in FIG. 2, and shows the first coupling element connected to a second coupling element on the harness breast strap.
Figure 4:
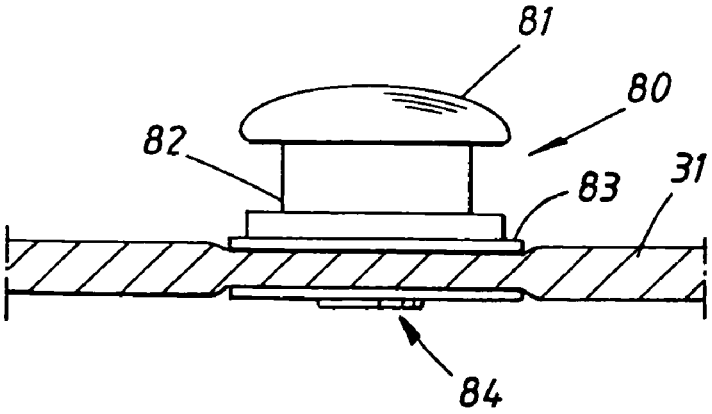
FIG. 4 is a schematic side view of the second coupling element.

As will be evident from FIG. 3, the strap arrangement 60 enables selective adjustment to be made to the distance between the coupling part 70 and the fitting 61, wherewith the part 125 will bend naturally in the configuration shown in FIG. 3, partly about a generally vertical fold line in the proximity of the seam 62 and partly in a longitudinal central part 128. The part 130 between the seam 69 and the fold 128 abuts the wearer's chest and the part 131 between the fold lines 127, 128 retains a generally flat state whose angle to the surface of the wearer's chest varies with the effect length of the strap 66. The part 131 forms a comfortable support surface for the babies head.

It will be understood that the bending edges/crease lines 127, 128, may, of course, be arranged in the front piece so as to ensure that it will bend at the places indicated. It will be understood that the strap arrangement 60 can be reached and maneuvered even when the upper edge part 122 is folded down against the lower part of the front piece 22, so as to allow the size of the upwardly facing opening of the pouch to be adjusted if so desired.

According to one particularly preferred embodiment of the invention, the coupling part 70 of the known coupling includes a flat ring-shaped coupling element 70 which can be releasably connected around a post 80.

This coupling arrangement enables the coupling element 70 to be connected to the post 80 in two rotational positions that are mutually separated by 180 degrees about a rotational axis corresponding to a generally horizontal diameter through the opening of the coupling part 70. The coupling part 70 is mounted so as to lie in the proximity of the fold line 124 through the front piece 22 when laid flat. Because the coupling part 70 is non-rotatably connected to the lateral extremities 125, the coupling arrangement 70, 80 will assist in keeping the edge part 122 folded down about the line 124. The front piece 22 is generally non-stretchable in its sheet-like plane but is preferably produced so that it will have a shape memory towards a sheet-like state. The flexible front piece 22 thereby has a tendency to keep the upper edge part 122 in the upwardly folded state shown in FIG. 1 through the influence of this elastic shape memory.

The front piece shown in FIG. 1 includes two mutually parallel and mutually spaced seams or decoration lines 201. Fastened between these lines 201 is a generally vertically orientated strip 202. Located outwardly of the lines 201 are two mutually similar front piece parts 204 which are generally mirror-image symmetrical and which are made of a flexible material which is generally non-stretchable in the sheet-like plane of said parts of the front piece. The material of said parts may consist, for instance, of two generally parallel layers of non-stretchable cloth or fabric and an intermediate of sheet of elastic plastic foam that imparts to said parts of the front piece a shape memory corresponding to a flat state of said parts of the front piece. The strip 202 of the illustrated example has a width of about 70 mm between the lines 201 and is arranged to be elastically stretchable at least in its horizontal direction, in other words perpendicular to the lines 201. The strip may conveniently be similarly stretchable elastically also in the vertical direction and preferably in all directions in its own plane.

The strip 202 had the following characteristics in a tested embodiment that provided particularly good comfort properties to babies carried in the baby carrier harness. A 10 cm long section of the 70 mm wide strip which has its vertical edges fastened to said parts 204 of the front piece via the seams 201 was subjected to a uniformly distributed load of 50N between its vertical edges and was found to experience an elastic increase in width of about 16 mm, i.e. a stretch of about 20%. A high degree of comfort can probably be obtained in constructions which afford an increase in strip width in the region of 5-30 mm, preferably in the region of 10-20 mm at such loads, it will be understood that the width of the strip may be greater or smaller than 70 mm, although preferably a width that lies in the range of 4-12 cm, more preferably in the range of 5-10 cm.

The strip 202 may have a net-like character 207. The parts 204 of the front piece may also be given a net-like character so as to provide a ventilating effect, which is favorable during warm times of the year.

A stiffening element may be included in the section of the strip 202 situated above the fold line 124, i.e. in the upper edge part 122, said stiffening element spreading vertically from the line 124 and the free edge of the upper edge part 122. The stiffening element is then able to prevent the fold area between the front piece and the downwardly folded upper edge part to wander upwards from the illustrated of the line 124 due to the load geometry.

When the strip-like element is formed of two mutually parallel and preferably net-like layers of material, the stiffening element may be placed between these layers and fastened through the front piece, for instance in the proximity of the free edge portion 122 of the upper edge so that the stiffening element will prevent any elastic variation in the width of that part of the strip-like element 202 above the fold line 124.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A baby carrier comprising a harness and a harness-carried front piece which forms a baby-carrying pouch, the front piece including two laterally separated parts at a variable spacing relative to one another, the laterally separated parts of the front piece being laterally separated by a distance and mutually connected to a strip-like piece of material having a lateral stretchability that is substantially greater than the lateral stretchability of the separated parts of the front piece, the strip-like piece of material having a uniform unstretched width over an entire length thereof, the unstretched width being a lateral dimension of the strip-like piece of material equal to said distance, the width between the laterally separated parts of the front piece defined by the strip-like piece of material being not less than the unstretched width of said strip-like piece of material independently of a force exerted by a carried baby on the front piece.

2. The baby carrier according to claim 1, wherein the parts of the front piece are flexible and generally non-stretchable in their respective sheet-like or extension planes.

3. The baby carrier according to claim 1, wherein the strip-like piece of material has the lateral stretchability in at least a length region between a lower anchoring fitting and a fold line for an upper downwardly foldable edge part of the front piece.

4. The baby carrier according to claim 1, wherein the strip-like piece of material has generally a uniform lateral stretchability over the entire length.

5. The baby carrier according to claim 1, wherein the strip-like piece of material is able to increase in width by 5-30 mm for a load of 50N that is uniformly distributed along a section of the strip-like piece of material that has a length of 10 cm.

6. The baby carrier according to claim 1, wherein the width of the strip-like piece of material is from 4 cm to 12 cm.

7. The baby carrier according to claim 1, wherein the strip-like piece of material has a net-like structure to provide a ventilation effect.

8. The baby carrier according to claim 2, wherein the strip-like piece of material has the lateral stretchability in at least a length region between a lower anchoring fitting and a fold line for an upper downwardly foldable edge part of the front piece.

9. The baby carrier according to claim 2, wherein the strip-like piece of material has generally a uniform lateral stretchability over the entire length.

10. The baby carrier according to claim 3, wherein the strip-like piece of material has generally a uniform lateral stretchability over the entire length.

11. The baby carrier according to claim 2, wherein the strip-like piece of material is able to increase in width by 5-30 mm for a load of 50N that is uniformly distributed along a section of the strip-like piece of material that has a length of 10 cm.

12. The baby carrier according to claim 3, wherein the strip-like piece of material is able to increase in width by 5-30 mm for a load of 50N that is uniformly distributed along a section of the strip-like piece of material that has a length of 10 cm.

13. The baby carrier according to claim 4, wherein the strip-like piece of material is able to increase in width by 5-30 mm for a load of 50 N that is uniformly distributed along a section of the strip-like piece of material that has a length of 10 cm.

14. The baby carrier according to claim 2, wherein the strip-like piece of material has a net-like structure to provide a ventilation effect.

15. The baby carrier according to claim 3, wherein the strip-like piece of material has a net-like structure to provide a ventilation effect.

16. The baby carrier according to claim 4, wherein the strip-like piece of material has a net-like structure to provide a ventilation effect.

17. The baby carrier according to claim 5, wherein the strip-like piece of material is configured to increase in width by from 10 mm to 20 mm for the load of 50N that is uniformly distributed along the section of the strip-like piece of material that has a length of 10 cm.

18. The baby carrier according to claim 6, wherein the width of the strip-like piece of material is from 5 cm to 10 cm.

19. A baby carrier comprising a harness and a harness-carried front piece which forms a baby-carrying pouch, the front piece including two laterally separated parts at a variable spacing relative to one another, the laterally separated parts of the front piece being laterally separated by a distance and mutually connected to a strip-like piece of material that has (i) a lateral stretchability that is substantially greater than the lateral stretchability of the separated parts of the front piece, (ii) a uniform unstretched width over an entire length thereof, the unstretched width being a lateral dimension of the strip-like piece of material equal to the distance, the width between the laterally separated parts of the front piece defined by the strip-like piece of material being not less than the unstretched width of said strip-like piece of material independently of a force exerted by a carried baby on the front piece, and (iii) a stiffening element included in a section thereof that forms an upper edge part of the front piece.

* * * * *